US011073343B2

(12) United States Patent
Gotterbarm et al.

(10) Patent No.: US 11,073,343 B2
(45) Date of Patent: Jul. 27, 2021

(54) METAL HEAT EXCHANGER TUBE

(71) Applicant: WIELAND-WERKE AG, Ulm (DE)

(72) Inventors: Achim Gotterbarm, Dornstadt (DE); Ronald Lutz, Blaubeuren (DE); Jean El Hajal, Ulm (DE); Manfred Knab, Dornstadt (DE)

(73) Assignee: WIELAND-WERKE AG, Ulm (DE)

( * ) Notice: Subject to any disclaimer, the term of this patent is extended or adjusted under 35 U.S.C. 154(b) by 279 days.

(21) Appl. No.: 15/103,193

(22) PCT Filed: Feb. 10, 2015

(86) PCT No.: PCT/EP2015/000278
§ 371 (c)(1),
(2) Date: Jun. 9, 2016

(87) PCT Pub. No.: WO2015/128061
PCT Pub. Date: Sep. 3, 2015

(65) Prior Publication Data

US 2016/0305717 A1 Oct. 20, 2016

(30) Foreign Application Priority Data

Feb. 27, 2014 (DE) ..... 10 2014 002 829.1

(51) Int. Cl.

| | |
|---|---|
| ***F28F 1/36*** | (2006.01) |
| ***F28F 1/42*** | (2006.01) |
| ***F28F 13/18*** | (2006.01) |
| ***F25B 39/00*** | (2006.01) |
| ***F28D 21/00*** | (2006.01) |
| ***F28F 13/08*** | (2006.01) |
| ***F25B 39/02*** | (2006.01) |

(52) U.S. Cl.
CPC ..... *F28F 1/36* (2013.01); *F25B 39/00* (2013.01); *F28D 21/0017* (2013.01);
(Continued)

(58) Field of Classification Search
CPC .... F28F 1/36; F28F 13/08; F28F 13/18; F28F 13/187; F28F 13/26; F28F 1/12;
(Continued)

(56) References Cited

U.S. PATENT DOCUMENTS 4,159,739 A * 7/1979 Brothers ..... B21C 37/207 165/133
4,168,618 A * 9/1979 Saier ..... B21C 37/207 165/184
(Continued)

FOREIGN PATENT DOCUMENTS

DE 197 57 526 C1 4/1999
DE 10 2008 013 929 B3 4/2009
(Continued)

OTHER PUBLICATIONS

EP2253922A2 English Machine Translation Retrieved Aug. 2017.*
(Continued)

*Primary Examiner* — Len Tran
*Assistant Examiner* — Jenna M Hopkins
(74) *Attorney, Agent, or Firm* — Flynn Thiel, P.C.

(57) ABSTRACT

A metal heat exchanger tube has integral ribs formed on the outside of the tube. The ribs have a rib base, rib flanks, and a rib tip. The rib base protrudes substantially radially from the tube wall. A channel is formed between the ribs, in which channel additional structures spaced apart from each other are arranged. The additional structures divide the channel between the ribs into segments. The additional structures reduce the cross-sectional area in the channel between two ribs through which flow is possible by at least 60% locally and, at least thereby, limit a fluid flow in the channel during operation.

17 Claims, 2 Drawing Sheets

(52) U.S. Cl.
CPC ..... *F28F 1/422* (2013.01); *F28F 13/08* (2013.01); *F28F 13/187* (2013.01); *F25B 39/02* (2013.01); *F25B 2339/0242* (2013.01); *F28D 2021/0064* (2013.01)

(58) Field of Classification Search
CPC .... F28F 1/122; F28F 1/124; F28F 1/16; F28F 1/126; F28F 1/18; F28F 1/28; F28F 1/34; F28F 1/38
USPC ..... 165/184, 133
See application file for complete search history.

(56) References Cited

U.S. PATENT DOCUMENTS 4,179,911 A * 12/1979 Saier ..... B21C 37/207 165/184
4,216,826 A * 8/1980 Fujikake ..... B21C 37/205 165/133
4,313,248 A * 2/1982 Fujikake ..... B21C 37/205 165/133
4,324,844 A * 4/1982 Kothmann ..... F28F 13/08 429/434
4,359,086 A * 11/1982 Sanborn ..... F28F 1/12 165/133
4,438,807 A * 3/1984 Mathur ..... F28F 1/42 165/133
4,549,606 A * 10/1985 Sato ..... F28F 13/04 165/179
4,577,381 A * 3/1986 Sato ..... B21C 37/20 165/133
4,602,681 A * 7/1986 Daikoku ..... F28F 13/187 165/133
4,653,163 A * 3/1987 Kuwahara ..... F28F 13/187 29/890.05
4,660,630 A * 4/1987 Cunningham ..... B21C 37/207 165/133
4,678,029 A * 7/1987 Sasaki ..... F28F 13/187 165/133
4,715,436 A * 12/1987 Takahashi ..... B21C 37/20 165/110
4,796,693 A * 1/1989 Kastner ..... B21C 37/207 165/133
4,799,543 A * 1/1989 Iversen ..... F28F 13/187 165/133
4,819,719 A * 4/1989 Grote ..... F28D 15/046 122/366
4,866,830 A * 9/1989 Zohler ..... B21C 37/207 29/890.048
4,921,042 A * 5/1990 Zohler ..... B21C 37/207 165/133
5,186,252 A * 2/1993 Nishizawa ..... F28F 13/187 165/181
5,203,404 A * 4/1993 Chiang ..... F28F 13/185 165/133
5,259,448 A * 11/1993 Masukawa ..... B21C 37/202 165/133
5,415,225 A * 5/1995 Randlett ..... F28F 1/26 165/133
5,482,744 A * 1/1996 Pearson ..... C23C 4/12 427/191
5,513,699 A * 5/1996 Menze ..... F28F 13/187 165/133
5,597,039 A * 1/1997 Rieger ..... F28F 1/42 165/133
5,669,441 A * 9/1997 Spencer ..... B21C 37/20 165/133
5,697,430 A * 12/1997 Thors ..... F28F 1/36 165/133
5,775,411 A * 7/1998 Schuez ..... F28F 13/182 165/133
5,832,995 A * 11/1998 Chiang ..... F28F 1/26 165/179
5,933,953 A * 8/1999 Spencer ..... B21C 37/207 29/727
6,056,048 A * 5/2000 Takahashi ..... F28D 3/02 165/133
6,067,712 A * 5/2000 Randlett ..... B21J 5/068 29/890.053
6,067,832 A * 5/2000 Brand ..... B21C 37/207 29/890.05
6,173,762 B1 * 1/2001 Ishida ..... F28F 1/42 165/133
6,176,302 B1 * 1/2001 Takahashi ..... F28F 1/36 165/133
6,336,501 B1 * 1/2002 Ishikawa ..... F28F 1/40 165/133
6,427,767 B1 * 8/2002 Mougin ..... F28F 1/36 165/133
6,786,072 B2 9/2004 Beutler et al.
6,913,073 B2 7/2005 Beutler et al.
7,254,964 B2 * 8/2007 Thors ..... F25B 39/02 165/184
8,091,616 B2 * 1/2012 Lu ..... B21C 37/26 165/133
8,162,039 B2 * 4/2012 Cao ..... F28F 1/36 165/133
8,281,850 B2 * 10/2012 Beutler ..... F28F 13/187 165/133
8,550,152 B2 10/2013 Beutler et al.
9,038,710 B2 * 5/2015 Cao ..... F28F 1/36 165/133
9,618,279 B2 * 4/2017 Lutz ..... F28F 13/187
9,844,807 B2 * 12/2017 Yalin ..... B21C 37/207
2002/0000312 A1 * 1/2002 Brand ..... F28F 13/187 165/179
2002/0070011 A1 * 6/2002 Itoh ..... F28F 1/40 165/133
2002/0074114 A1 * 6/2002 Fijas ..... F28F 1/36 165/184
2002/0092644 A1 * 7/2002 Beutler ..... B21C 37/207 165/133
2002/0096314 A1 * 7/2002 Liu ..... B21C 37/20 165/133
2002/0104216 A1 * 8/2002 Stikeleather ..... B21C 37/16 29/890.048
2003/0024121 A1 2/2003 Beutler et al.
2003/0136547 A1 * 7/2003 Gollan ..... C25D 5/022 165/104.21
2004/0069467 A1 * 4/2004 Thors ..... B21C 37/20 165/133
2006/0112557 A1 * 6/2006 Buerger ..... B21B 1/227 29/890.053
2007/0034361 A1 * 2/2007 Lu ..... F28F 1/26 165/133
2007/0131396 A1 * 6/2007 Yu ..... F25B 39/04 165/133
2007/0151715 A1 * 7/2007 Yunyu ..... F28F 1/38 165/133
2008/0196876 A1 * 8/2008 Cao ..... F28F 1/36 165/181
2008/0236803 A1 * 10/2008 Cao ..... F28F 1/422 165/179
2009/0008069 A1 * 1/2009 Luo ..... F28F 1/36 165/151
2009/0166018 A1 * 7/2009 Lundgreen ..... F24F 6/18 165/173
2009/0178789 A1 * 7/2009 Luo ..... F25B 39/04 165/157
2009/0229806 A1 * 9/2009 Lu ..... B21C 37/26 165/177
2009/0229807 A1 * 9/2009 Beutler ..... F28F 13/187 165/182
2009/0260792 A1 * 10/2009 Yalin ..... B21C 37/207 165/181
2010/0193170 A1 * 8/2010 Beutler ..... B21C 37/207 165/181
2010/0282456 A1 * 11/2010 Benignos ..... F28F 1/30 165/182

(56) References Cited

U.S. PATENT DOCUMENTS

| | | | | |
|---|---|---|---|---|
| 2010/0288480 | A1* | 11/2010 | Beutler | F28F 1/40 165/181 |
| 2011/0083619 | A1* | 4/2011 | Master | F22B 1/16 122/32 |
| 2011/0146963 | A1* | 6/2011 | Gotterbarm | B21C 37/207 165/181 |
| 2012/0077055 | A1* | 3/2012 | Fujii | B21C 37/02 428/600 |
| 2012/0111551 | A1* | 5/2012 | Cao | F28F 1/36 165/181 |
| 2012/0325443 | A1* | 12/2012 | Miyata | F28F 1/36 165/162 |
| 2013/0220586 | A1* | 8/2013 | Sun | F28D 3/02 165/181 |
| 2014/0083668 | A1* | 3/2014 | Deng | F28F 1/40 165/181 |
| 2014/0284036 | A1* | 9/2014 | Gotterbarm | F28F 1/24 165/181 |
| 2014/0352939 | A1* | 12/2014 | Lutz | F28F 13/187 165/177 |

FOREIGN PATENT DOCUMENTS

| | | | | |
|---|---|---|---|---|
| DE | 102008013929 | B3 * | 4/2009 | F28F 13/187 |
| DE | 2253922 | A2 * | 11/2010 | F28F 1/26 |
| DE | 102011121733 | A1 * | 6/2013 | F28F 13/187 |
| EP | 0 222 100 | B1 | 5/1987 | |
| EP | 0 495 453 | A1 | 7/1992 | |
| EP | 1 223 400 | B1 | 7/2002 | |
| EP | 2 253 922 | A2 | 11/2010 | |
| JP | 59046490 | A * | 3/1984 | F28F 13/187 |
| JP | 59093190 | A | 5/1984 | |
| JP | 0495453 | A1 * | 7/1992 | F28F 1/26 |
| JP | 2010266189 | A * | 11/2010 | F28F 1/26 |
| WO | WO-2012135983 | A1 * | 10/2012 | F28F 1/422 |

OTHER PUBLICATIONS

Augmentation of Heat Transfer, Two-Phase—Bergles (2011).*

Enhancement of Pool Boiling—Bergles (1997).*

Pool Boiling Heat Transfer and Bubble Dynamics Over Plain and Enhanced Microchannels—Kandlikar (2011).*

International Search Report with English translation issued in International Application No. PCT/EP2015/000278 dated May 21, 2015 (5 pages).

Written Opinion of International Searching Authority issued in International Application No. PCT/EP2015/000278 dated May 21, 2015 (5 pages).

Office Action of German Patent Office issued in Application No. 10 2014 002 829.1 dated Nov. 10, 2014 (4 pages).

* cited by examiner

METAL HEAT EXCHANGER TUBE

The invention relates to a metal heat exchanger tube.

Evaporation occurs in numerous sectors of refrigeration and air-conditioning engineering and in process and power engineering. Use is frequently made of tubular heat exchangers in which liquids evaporate from pure substances or mixtures on the outside of the tube and, in the process, cool a brine or water on the inside of the tube. Such apparatuses are referred to as flooded evaporators.

By making the heat transfer on the outside and inside of the tube more intensive, the size of the evaporators can be greatly reduced. By this means, the production costs of such apparatuses decrease. In addition, the required volume of refrigerants is reduced, which is important in view of the fact that the chlorine-free safety refrigerants which are predominantly used meanwhile may form a not insubstantial portion of the overall equipment costs. In addition, the high-power tubes customary nowadays are already approximately four times more efficient than smooth tubes of the same diameters.

The highest performance commercially available finned tubes for flooded evaporators have a fin structure on the outside of the tube with a fin density of 55 to 60 fins per inch (U.S. Pat. Nos. 5,669,441 A; 5,697,430 A; DE 197 57 526 C1). This corresponds to a fin pitch of approx. 0.45 to 0.40 mm.

Furthermore, it is known that evaporation structures of improved performance can be produced with the fin pitch remaining the same on the outside of the tube by additional structural elements being introduced in the region of the groove base between the fins.

It is proposed in EP 1 223 400 B1 to produce undercut secondary grooves on the groove base between the fins, said secondary grooves extending continuously along the primary groove. The cross-section of said secondary grooves can remain constant or can be varied at regular intervals.

In addition, DE 10 2008 013 929 B3 discloses structures on the groove base that are designed as local cavities, as a result of which, in order to increase the transfer of heat during evaporation, the process of nucleate boiling is intensified. The position of the cavities in the vicinity of the primary groove base is favorable for the evaporation process since the excess temperature is at the greatest at the groove base and therefore the highest driving temperature difference for the formation of bubbles is available there.

Further examples of structures on the groove base can be found in EP 0 222 100 B1, U.S. Pat. No. 7,254,964 B2 or U.S. Pat. No. 5,186,252 A. A common feature of said structures is that the structural elements do not have an undercut shape on the groove base. These are either indentations introduced into the groove base or projections in the lower region of the channel. Higher projections are explicitly ruled out in the prior art since it appears to be of concern that the fluid flow in the channel is disadvantageously obstructed for heat exchange.

The invention is based on the object of developing a heat exchanger tube with an improved performance for evaporating liquids on the outside of the tube.

The invention is reproduced by the claimed features and advantageous embodiments and developments of the invention.

The invention includes a metal heat exchanger tube, comprising integral fins which are formed on the outside of the tube and have a fin foot, fin flanks and a fin tip, wherein the fin foot protrudes substantially radially from the tube wall, and a channel in which spaced-apart additional structures are arranged is formed between the fins. The additional structures divide the channel between the fins into segments. The additional structures reduce the throughflow cross-sectional area in the channel between two fins locally by at least 60% and thereby at least limit a fluid flow in the channel during operation.

These metal heat exchanger tubes serve in particular for evaporating liquids from pure substances or mixtures on the outside of the tube.

Efficient tubes of this type can be produced on the basis of integrally rolled finned tubes. Integrally rolled finned tubes are understood as meaning finned tubes in which the fins have been formed from the wall material of a smooth tube. Typical integral fins formed on the outside of the tube are, for example, spirally encircling and have a fin foot, fin flanks and a fin tip, wherein the fin foot protrudes substantially radially from the tube wall. The number of the fins is established by counting consecutive bulges in the axial direction of a tube.

Various methods with which the channels located between adjacent fins are closed in such a manner that connections between the channels and environment remain in the form of pores or slits are known in this connection. In particular, such substantially closed channels are produced by bending or folding over the fins, by splitting and upsetting the fins or by notching and upsetting the fins.

The invention is based here on the consideration that, in order to increase the transfer of heat during evaporation, the fin intermediate space is segmented by additional structures. The additional structures can be formed here in solid form from the channel base at least partially from material of the tube wall. The additional structures are arranged preferably here at regular intervals starting from the channel base and extend transversely with respect to the course of the channel, starting from one fin foot of a fin to the next fin foot lying adjacent. The additional structures can also extend radially from the fin foot as far as the fin flank and therebeyond. In other words: the additional structures run transversely with respect to the primary groove from the channel base, for example in the form of solid material projections, and separate said primary groove into individual segments, like a weir as a transverse barrier over which the flow can only conditionally pass. In this manner, the primary groove as the channel is already at least partially subdivided at regular intervals starting from the channel base.

By this means, local overheating is generated in the intermediate spaces, and the process of nucleate boiling is intensified. The formation of bubbles then takes place primarily within the segments and begins at nucleation sites. At said nucleation sites, first of all small gas or vapor bubbles form. When the growing bubble has reached a certain size, it detaches itself from the surface. Over the course of the bubble detachment, the remaining cavity in the segment is flooded again with liquid and the cycle begins again. The surface can be configured in such a manner that, when the bubble detaches, a small bubble remains behind which then serves as a nucleation site for a new bubble formation cycle.

In the present invention, by means of the segmentation of the channel between two fins, said channel is interrupted time and again in the peripheral direction and thus at least reduces or entirely prevents the migration of the arising bubbles in the channel. The exchange of liquid and vapor along the channel is assisted by the respective additional structure to an increasingly lesser degree to even not at all.

The particular advantage of the invention consists in that the exchange of liquid and vapor takes place in a manner controlled in a locally specific way and the flooding of the bubble nucleation site in the segment takes place locally. Overall, by means of a targeted choice of the segmentation of the channel, the evaporator tube structures can be expediently optimized depending on the use parameters, and therefore an increase in the transfer of heat is achieved. Since the temperature of the fin foot is higher in the region of the groove base than at the fin tip, structural elements for intensifying the formation of bubbles in the groove base are also particularly effective.

In addition, it is also possible for the additional structures to reduce the throughflow cross-sectional area in the channel between two fins locally by at least 80%. Overall, by means of an increasing separation of individual channel sections in the segmenting of the channel, the evaporator tube structures can be further optimized, depending on the use parameters, in order to increase the transfer of heat.

In an advantageous embodiment of the invention, the additional structures can completely close the throughflow cross-sectional area in the channel between two fins locally. The segments are thereby completely closed locally to a passage of fluid. The channel section located between two segments is therefore separated in terms of fluid from channel sections lying adjacent.

In a preferred refinement of the invention, the channel can be closed radially outward except for individual local openings. The fins here can have a substantially T-shaped or Γ-shaped cross-section, as a result of which the channel between the fins is closed except for pores as local openings. The vapor bubbles arising during the evaporation process can escape through said openings. The fin tips are deformed by methods which can be gathered from the prior art.

By combining the segments according to the invention with a channel which is closed except for pores or slits, a structure is obtained which has a very high efficiency for the evaporation of liquids over a very wide range of operating conditions. In particular, the coefficient of heat transfer of the structure achieves a consistently high level in the event of a variation of the heat flow density or the driving temperature difference.

In an advantageous refinement of the invention, there can be at least one local opening per segment. This minimum requirement also ensures that gas bubbles arising in a channel segment during the evaporation process can escape to the outside. The local openings are designed in size and shape in such a manner that even a liquid medium can pass therethrough and flow into the channel section. So that the evaporation process can be maintained at a local opening, the same quantities of liquid and vapor consequently have to be transported through the opening in mutually opposed directions. Liquids which readily wet the tube material are customarily used. A liquid of this type can penetrate the channels through each opening in the outer tube surface, even counter to a positive pressure, because of the capillary effect.

In a particularly preferred refinement, the quotient of the number of local openings to the number of segments can be 1:1 to 6:1. Furthermore preferably, said quotient can be 1:1 to 3:1. The channels located between the fins are substantially closed by the material of the upper fin regions, wherein the resulting cavities in the channel segments are connected by openings to the surrounding space. Said openings may also be configured as pores which can be formed in the same size or else in two or more size classes. At a ratio at which a plurality of local openings are formed on a segment, pores with two size classes may be particularly suitable. For example, a large opening follows each small opening along the channels in accordance with a regular recurring scheme. This structure produces a directed flow in the channels. Liquid is preferably drawn in through the small pores with the assistance of the capillary pressure and wets the channel walls, as a result of which thin films are produced. The vapor accumulates in the center of the channel and escapes at locations having the lowest capillary pressure. At the same time, the large pores have to be dimensioned in such a manner that the vapor can escape sufficiently rapidly and the channels do not dry out in the process. The size and frequency of the vapor pores in relation to the smaller liquid pores should then be coordinated with one another.

In an advantageous manner, first additional structures can be radially outwardly directed projections emerging from the channel base. By this means, the exchange of liquid and vapor is also defined locally. The segmentation of the channel over the groove base is particularly favorable for the evaporation process here since the excess temperature is at the greatest at the groove base and therefore the highest driving temperature difference for the formation of bubbles is available there.

In a preferred embodiment of the invention, the first additional structures can be formed at least from the material of the channel base between two integrally encircling fins. By this means, an integrally bonded connection is maintained for a good heat exchange from the tube wall into the respective structural elements. The segmentation of the channel from a homogeneous material of the channel base is particularly favorable for the evaporation process.

In a particularly preferred embodiment, the first additional structures formed from the channel base can have a height of between 0.15 and 1 mm. This dimensioning of the additional structures is particularly readily coordinated with the high-performance finned tubes and is expressed by the fact that the structural sizes of the outer structures preferably lie in the submillimeter to millimeter range.

In a further advantageous refinement of the invention, second additional structures can be formed at least from the fin flanks of the integrally encircling fins via lateral projections. This can be formed from the material of the channel base alternatively or additionally to further projections.

In a preferred embodiment of the invention, the second additional structures can be formed at least from one fin emerging from the fin tip in the direction toward the channel base. Consequently, the channel may also be tapered by the desired amount from below and/or from the side and/or from above from a combination of a plurality of complementary structural elements or entirely closed. The channel is always subdivided into discrete segments between the fins.

In a further additional embodiment, additional structures can be at least partially provided via additional material. Additional material may differ here from the material of the rest of the heat exchanger tube in structure and with regard to the interaction with the fluid selected for the operation. For example, it is also conceivable here to use materials having different surface properties in relation to the fluid which is used.

In an advantageous manner, the additional structures can have asymmetric shapes. The asymmetry of the structures appears here in a section plane running perpendicularly to the tube axis. Asymmetric shapes can make an additional contribution to the evaporation process, in particular if a relatively large surface is formed. The asymmetry can be formed both in the case of additional structures on the channel base and also at the fin tip.

In a preferred embodiment of the invention, the additional structures can have a trapezoidal cross-section in a section plane running perpendicularly to the tube axis. Trapezoidal cross-sections in conjunction with integrally rolled finned tube structures are technologically readily controllable structural elements. Slight manufacturing-induced asymmetries in the otherwise parallel main sides of a trapezoid may occur here.

In an advantageous manner, the respective throughflow cross-sectional area in the channel between two fins that is reduced by additional structures may vary. In this manner, locally more or less continuous regions may be created in the channel. For this purpose, for example, additional structures on the channel base may have a different height.

BRIEF DESCRIPTION OF THE DRAWINGS

Exemplary embodiments of the invention are explained in more detail with reference to the schematic drawings, in which.

DETAILED DESCRIPTION OF THE INVENTION

Mutually corresponding parts are provided with the same reference signs in all of the figures.

Figure 1:
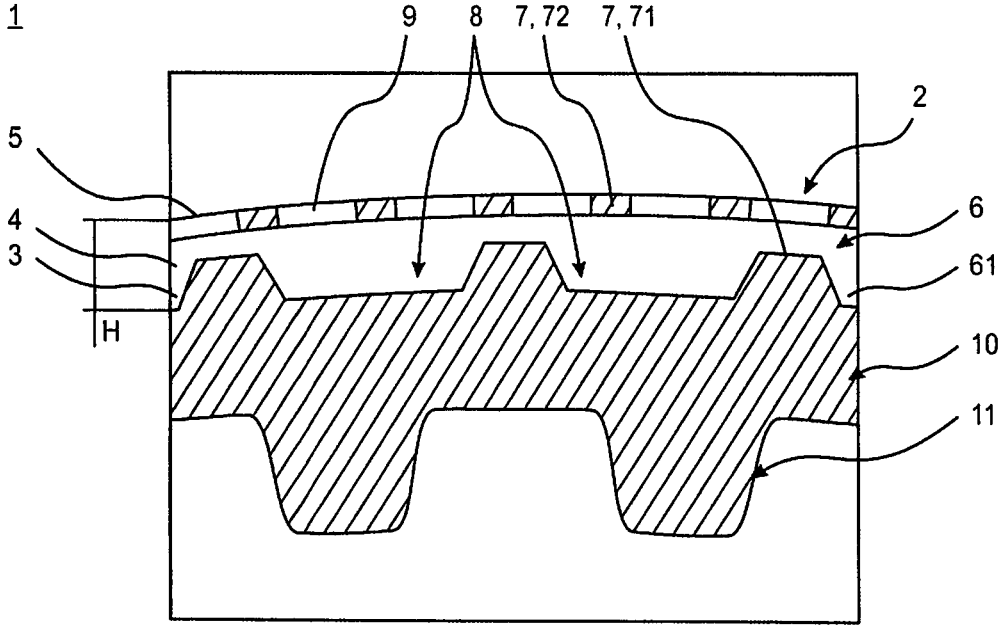
FIG. 1 shows schematically a partial view of a cross section of a heat exchanger tube with segments subdivided by additional structures.

FIG. 1 shows schematically a partial view of a cross-section of a heat exchanger tube 1 according to the invention with segments 8 subdivided by additional structures 7. The integrally rolled heat exchanger tube 1 has helically encircling fins 2 on the outside of the tube, between which a primary groove is formed as the channel 6. The fins 2 extend continuously without interruption along a helix line on the outside of the tube. The fin foot 3 protrudes substantially radially from the tube wall 10. On the finished heat exchanger tube 1, the fin height H is measured, starting from the lowest point of the channel base 61, from the fin foot 3 beyond the fin flank 4 to the fin tip 5 of the completely formed finned tube. A heat exchanger tube 1 is proposed in which an additional structure 7 in the form of solid projections 71 is arranged in the region of the channel base 61. Said projections 71 are referred to as a first additional structure and are formed from the channel base 61 from the material of the tube wall 10. The solid projections 71 are arranged at preferably regular intervals in the channel base 61 and extend transversely to the course of the channel from a fin foot 3 of a fin 2 to the next fin foot lying thereabove (not illustrated in the figure plane). In this manner, the primary groove as channel 6 is at least partially tapered at regular intervals. The resulting segment 8 promotes formation of bubble nuclei in a particular manner. The exchange of liquid and vapor between the individual segments 8 is thereby reduced.

In addition to the formation of the projections 71 on the channel base 61, the fin tips 5 as the distal region of the fins 2 are expediently deformed in such a manner that they partially close the channel 6 in the radial direction as a further second additional structure 72. The connection between the channel 6 and the environment is configured in the form of pores 9 as local openings so that vapor bubbles can escape from the channel 6. The fin tips 5 are deformed by methods which can be gathered from the prior art. The primary grooves 6 thereby constitute undercut grooves. By means of the combination of the first and second additional structures 71 and 72 according to the invention, a segment 8 is obtained in the form of a cavity which is furthermore distinguished in that it has a very high efficiency for the evaporation of liquids over a very wide range of operating conditions. The liquid evaporates within the segment 8. The resulting vapor emerges from the channel 6 at the local openings 9, through which liquid fluid also flows. Readily wettable tube surfaces may also be an aid for the flowing-in of the fluid.

Figure 2:
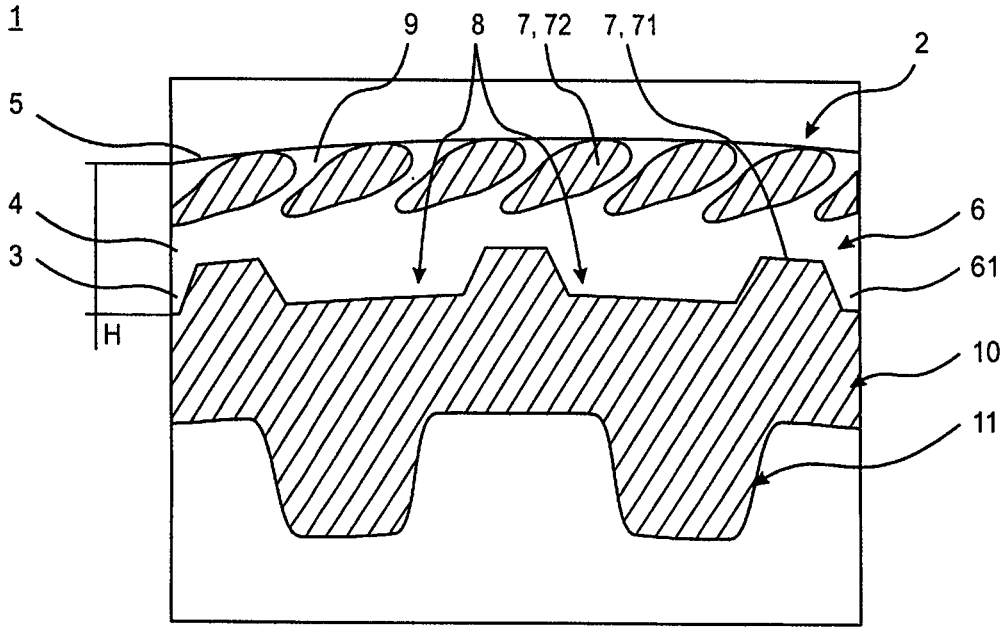
FIG. 2 shows schematically a partial view of a cross section of a further heat exchanger tube with varied additional structures in the region of the fin tip.

FIG. 2 shows schematically a partial view of a cross-section of a further heat exchanger tube 1 with varied second additional structures 72 in the region of the fin tip 5. In addition to the formation of the projections 71 at the channel base 61, the fin tips 5 as the distal region of the fins 2 are in turn deformed in such a manner that they partially close the channel 6 in the radial direction as a further second additional structure 72. The connection between the channel 6 and the environment is configured as local openings 9 in the form of obliquely running tubes for the escape of vapor bubbles from the channel 6 and the flow of liquid fluid into the channel 6. In this manner, the primary grooves 6 constitute in turn undercut grooves. The second additional structure 72 is formed from a fin starting from the fin tip 5 in the direction toward the channel base 61 and thus projects into the channel 6 in the radial direction. As soon as a first and a second additional structure lie one above the other, as viewed radially, the throughflow cross-sectional area in the channel 6 between two fins 2 is reduced particularly effectively locally in order thereby to limit the fluid flow in the channel 6 during operation.

Figure 3:
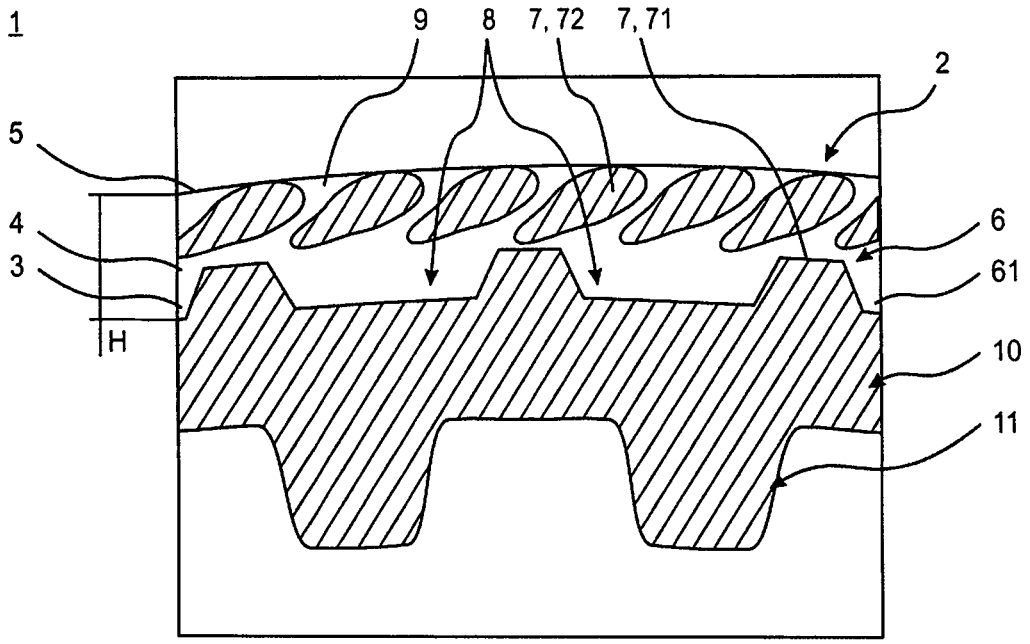
FIG. 3 shows schematically a partial view of a cross section of a heat exchanger tube with virtually closed segments.

FIG. 3 shows schematically a partial view of a cross-section of a heat exchanger tube 1 with the additional structures 7 from FIG. 2. The second additional structures 72 project into the channel 6 virtually as far as the projections of the first additional structures 71, and therefore virtually closed segments 8 are formed. In this case, the quotient of the number of local openings 9 to the number of segments 8 lies within the preferred range of 1:1 to 3:1 and in the section is approximately 1.7:1 to 2.3:1. All of the local openings 9 designed as tubes are still permeable here, even if an opening 9 comes to lie above a projection 71. The resulting vapor can still emerge from the channel 6 at the local openings 9. The liquid fluid, because of its surface tension, can flow particularly efficiently in the tubes 9 by means of capillary action.

By means of the combination of the first and second additional structures 71 and 72 according to the invention, a segment 8 is obtained in the form of a cavity which is furthermore distinguished in that it has a very high efficiency for the evaporation of liquids over a very wide range of operating conditions. In particular, the coefficient of heat transfer of the structure remains virtually constant at a high level in the event of variation of the heat flow density or the driving temperature difference. The solution according to the invention relates to structured tubes in which the coefficient of heat transfer is increased on the outside of the tube. In order not to shift the main portion of the heat throughput resistance to the inside, the coefficient of heat transfer can be additionally intensified on the inside by means of a suitable internal structuring 11. The heat exchanger tubes 1 for tubular heat exchangers customarily have at least one structured region and smooth end pieces and possibly smooth intermediate pieces. The smooth end pieces and/or intermediate pieces bound the structured regions. So that the heat exchanger tube 1 can be easily installed in the tubular heat exchanger, the outer diameter of the structured regions should not be larger than the outer diameter of the smooth end and intermediate pieces.

LIST OF REFERENCE SIGNS

1 heat exchanger tube
2 fins
3 fin foot
4 fin flank
5 fin tip, distal regions of the fins
6 channel, primary groove
61 channel base
7 additional structures
71 first additional structure in the form of projections on the channel base
72 second additional structure in the region of the fin tip
8 segment
9 local opening, pores, tubes
10 tube wall
11 internal structure

The invention claimed is:

1. A metal heat exchanger tube comprising:
a tube wall;
a plurality of integrally encircling fins formed on the outside of the tube, wherein each fin has a fin foot, fin flanks and a fin tip, and the fin foot protrudes radially from the tube wall, and
a channel formed between two adjacent fins, wherein the channel has a throughflow cross-sectional area perpendicular to the course of the channel, and
spaced-apart additional structures arranged in portions of the channel,
a first total throughflow cross-sectional area A1 being the minimum total throughflow cross-section area measured perpendicular to the course of the channel in the portions of the channel where the additional structures are arranged;
a second total throughflow cross-sectional area A2 being the maximum total throughflow cross-section area measured perpendicular to the course of the channel in the portions of the channel where the additional structures are not arranged;
wherein the additional structures divide the channel into segments, and
wherein a reduction of the first total throughflow cross-sectional area A1 relative to the second total throughflow cross-sectional area A2 is at least 60% of the second total throughflow cross-sectional area A2.

2. The heat exchanger tube as claimed in claim 1, wherein the additional structures reduce the throughflow cross-sectional area in the portions of the channel in which they are arranged by at least 80% as compared to the portions of the channel in which they are not arranged.

3. The heat exchanger tube as claimed in claim 2, wherein the additional structures completely close the throughflow cross-sectional area in the portions of the channel in which they are arranged.

4. The heat exchanger tube as claimed in claim 1, wherein the channel is closed radially outward except for individual openings.

5. The heat exchanger tube as claimed in claim 1, wherein there is at least one individual opening per segment.

6. The heat exchanger tube as claimed in claim 5, wherein the quotient of the number of individual openings to the number of segments is 1:1 to 6:1.

7. The heat exchanger tube as claimed in claim 1, wherein the additional structures comprise first additional structures that are radially outwardly directed projections emerging from a base of the channel.

8. The heat exchanger tube as claimed in claim 7, wherein the first additional structures are formed at least partially from material of the tube wall from the channel base.

9. The heat exchanger tube as claimed in claim 8, wherein the first additional structures formed from the channel base have a height of between 0.15 and 1 mm.

10. The heat exchanger tube as claimed in claim 7, wherein the additional structures comprise second additional structures that are formed at least from the fin flanks or fin tips of the integrally encircling fins via lateral projections.

11. The heat exchanger tube as claimed in claim 10, wherein the second additional structures are formed at least from one fin emerging from the fin tip in the direction toward the channel base.

12. The heat exchanger tube as claimed in claim 1, wherein additional structures are at least partially provided via additional material.

13. The heat exchanger tube as claimed in claim 1, wherein the additional structures have asymmetric shapes.

14. The heat exchanger tube as claimed in claim 1, wherein additional structures have a trapezoidal cross section in a section plane running perpendicularly to the tube axis.

15. The heat exchanger tube as claimed in claim 1, wherein the respective throughflow cross-sectional area in the channel between two fins that is reduced by additional structures varies.

16. A metal heat exchanger tube comprising:
a tube wall;
a plurality of integrally encircling fins formed on the outside of the tube, wherein each fin has a fin foot, fin flanks and a fin tip, and the fin foot protrudes radially from the tube wall, and
a channel formed between two adjacent fins, wherein the channel has a through flow cross-sectional area perpendicular to the course of the channel, and
spaced-apart additional structures arranged in portions of the channel,
a first total throughflow cross-sectional area A1 being the minimum total throughflow cross-section area measured perpendicular to the course of the channel in the portions of the channel where the additional structures are arranged;
a second total throughflow cross-sectional area A2 being the maximum total throughflow cross-section area measured perpendicular to the course of the channel in the portions of the channel where the additional structures are not arranged;
wherein the additional structures divide the channel into segments,
wherein a reduction of the first total throughflow cross-sectional area A1 relative to the second total throughflow cross-sectional area A2 is at least 60% of the second total throughflow cross-sectional area A2.

17. A metal heat exchanger tube comprising:
a tube wall;
a plurality of integrally encircling fins formed on the outside of the tube, wherein each fin has a fin foot, fin flanks and a fin tip, and the fin foot protrudes radially from the tube wall, and
a channel formed between two adjacent fins, wherein the channel has a throughflow cross-sectional area perpendicular to the course of the channel, and spaced-apart additional structures arranged in portions of the channel, wherein the additional structures divide the channel into segments, wherein first ones of the additional structures project from a base of the channel and second ones of the additional structures extend radially from the fin tip such that when the second ones of the additional structures lie above the first additional structures as viewed radially there is a reduction in the throughflow cross-sectional area in the channel between two adjacent fins in order to limit fluid flow in the channel by at least 60%.

* * * * *